United States Patent [19]

Kobayashi et al.

[11] Patent Number: 5,060,120

[45] Date of Patent: Oct. 22, 1991

[54] VARIABLE DISTRIBUTION TYPE AUTOMOTIVE HEADLAMP

[75] Inventors: Syoji Kobayashi; Michihiko Hayakawa, both of Shizuoka, Japan

[73] Assignee: Koito Manufacturing Co., Ltd., Tokyo, Japan

[21] Appl. No.: 679,970

[22] Filed: Apr. 3, 1991

[30] Foreign Application Priority Data

Apr. 19, 1990 [JP] Japan ..... 2-41122[U]

[51] Int. Cl.[5] ..... F21M 3/20

[52] U.S. Cl. ..... 362/61; 362/282; 362/297

[58] Field of Search ..... 362/61, 277, 279, 282, 362/283, 284, 297, 298, 301, 346, 319, 322, 324

[56] References Cited

U.S. PATENT DOCUMENTS

| | | | |
|---|---|---|---|
| 1,935,621 | 11/1933 | Donnelly | 362/279 |
| 4,811,174 | 3/1989 | Kanzler et al. | 362/61 |
| 4,928,214 | 5/1990 | Oyama | 362/297 |

*Primary Examiner*—Ira S. Lazarus
*Assistant Examiner*—Richard R. Cole
*Attorney, Agent, or Firm*—Sughrue, Mion, Zinn Macpeak & Seas

[57] ABSTRACT

A variable distribution type automotive headlamp employing a bulb of a single-filament type positioned on the optical axis of a reflector. The reflector is constituted by a main reflecting surface having a focal point substantially at the position of the bulb and a pair of subsidiary reflecting sources provided on the main reflecting surface so as to be left-and-right symmetrical with respect to the optical axis. Both the subsidiary reflecting mirror surfaces are opposed to each other so that the optical axis of each of the subsidiary reflecting mirror surfaces is inclined relative to the optical axis of the main reflecting surface within a horizontal plane and within a range of from 45 to 80 degrees. The distance between the optical axis of the main reflecting surface and each of the subsidiary reflecting surfaces is made longer than that between the center of the main reflecting surface and the focal point thereof. At least one of a pair of movable mirrors provided in a lamp chamber so as to deflectively reflect light reflected from the subsidiary reflecting surfaces substantially parallel to the optical axis is pivoted so that its angle of inclination can be changed by a movable-mirror driving mechanism in a horizontal section or in a vertical section.

10 Claims, 7 Drawing Sheets

VARIABLE DISTRIBUTION TYPE AUTOMOTIVE HEADLAMP

BACKGROUND OF THE INVENTION

The present invention relates to a variable distribution type automotive headlamp in which the light distribution pattern can be controlled so as to be most suitable for current operating conditions. More particularly, the invention relates to such headlamps provided with a light source such as a single-filament type bulb.

Conventionally, variable distribution type headlamps use a double-filament type bulb mounted so that the two filaments Io are aligned with the forward optical axis of a reflector. The two filaments are selectively illuminated so as to change the diffusion angle of the luminous flux to thereby change the light distribution pattern, so that a main beam and a sub-beam are obtained.

However, a headlamp having a structure has a problem that a reflector having reflecting surfaces corresponding to two filament positions must be provided, as a result of which the structure of the reflecting surfaces becomes complicated. Moreover, the reflection direction of the luminous flux differs o depending on the bulb mounting position, so that sometimes a suitable light distribution pattern cannot be obtained.

FIG. 16 shows a lamp of the above type in which the direction of the luminous flux can be changed in the horizontal direction, as disclosed in U.S. Pat. No. 3,333,094. The lamp includes a bulb 51 provided at the focal point F of a reflector 50 having a parabolic reflecting surface. The front surface of the lamp is covered with a front lens 52. A plurality of pivotally mounted reflecting plates 53 provided between the front lens 52 and the reflector 50 can be rotated to the left or right (through an angle $\phi$), so that the output light flux is swung left/right (through an angle of $2\phi$) so as to be suitably directed for operating conditions such as driving on a curved road or the like. lD In such a distribution type headlamp as described above, however, the luminous flux which can be controlled by the reflecting plates 53 increases as the rotation angle $\phi$ increases, so that the effect for improving visibility is small in the case where the rotation angle $\phi$ of the reflecting plates 53 is small. Further, not only does the loss of light due to the plate thickness of many reflecting plates 53 become large, but the focal length of the reflector 50 is relatively short, so that the image of the filament of the bulb 51 becomes large. As a result, there is a problem that the vertical width of the zo luminous flux deflected by the respective reflecting plates 53 is so large that an improvement in distant visibility cannot be obtained.

SUMMARY OF THE INVENTION

The present invention has been attained in view of the problems described above, and an object thereof is to provide a headlamp having a variable distribution function employing an incandescent bulb of a single-filament type, a discharge bulb such as a metal halide bulb, or the like, to thereby obtain improved safety for night driving, driving in a tunnel, or the like, the variable distribution function including:

(1) changing the (2) swinging a part of the beam in the turning direction of the vehicle in response to changes in the steering angle such as when traveling on a curved road;

(3) diffusing/focusing the luminous flux in response to vehicle speed so as to increase/decrease the amount of illumination in the vicinity of the optical axis; and (4) swinging the beam away from an oncoming vehicle so as to avoid dazzling or blinding the driver thereof, particularly under specific conditions such as when it is raining.

A further object of the present invention is to provide a variable distribution type headlamp capable of performing the above operations, whose structure is simple, and a desired light-distribution pattern can be easily achieved.

The variable distribution type automotive headlamp according to the present invention is characterized in that a bulb of a single-filament type is positioned on the optical axis of a reflector. The reflector is const-ituted by a main reflecting surface having a focal point substantially at the position of the bulb and a pair of subsidiary reflecting sources provided on the main reflecting surface so as to be left-and-right symmetrical with respect to the optical axis. Both the subsidiary reflecting mirror surfaces are opposed to each other so that the optical axis of each of the subsidiary reflecting mirror surfaces is inclined relative to the optical axis of the main reflecting surface within a horizontal plane and within a range of from 45 to 80 degrees. The distance between the optical axis of the main reflecting surface and each of the subsidiary reflecting surfaces is made longer than that between the center of the main reflecting surface and the focal point thereof. At least one of a pair of movable mirrors provided in a lamp chamber so as to deflectively reflect light reflected from the subsidiary reflecting surfaces substantially parallel to the optical axis is rotatably pivoted or pivoted in such a manner that its angle of inclination can be changed by a movable-mirror driving mechanism in a horizontal section or in a vertical section.

In the inventive arrangement described above, the light reflected from the subsidiary reflecting surfaces formed on a part of the main reflecting surface of the reflector is received by a pair of the movable mirrors provided in the lamp chamber, and the movable mirrors are controlled and driven so as to swing left/right or up/d-own the luminous flux at that position. Accordingly, the illumination pattern produced by this lamp can be easily configured so that the lamp has a very small illuminance loss. Further, because the luminous flux is controlled by a pair of movable mirrors, and neither of the movable mirrors is provided on the optical axis including the bulb, the depth of the lamp can be reduced so that the lamp can be reduced in overall size.

DESCRIPTION OF THE PREFERRED EMBODIMENTS

Figure 1:
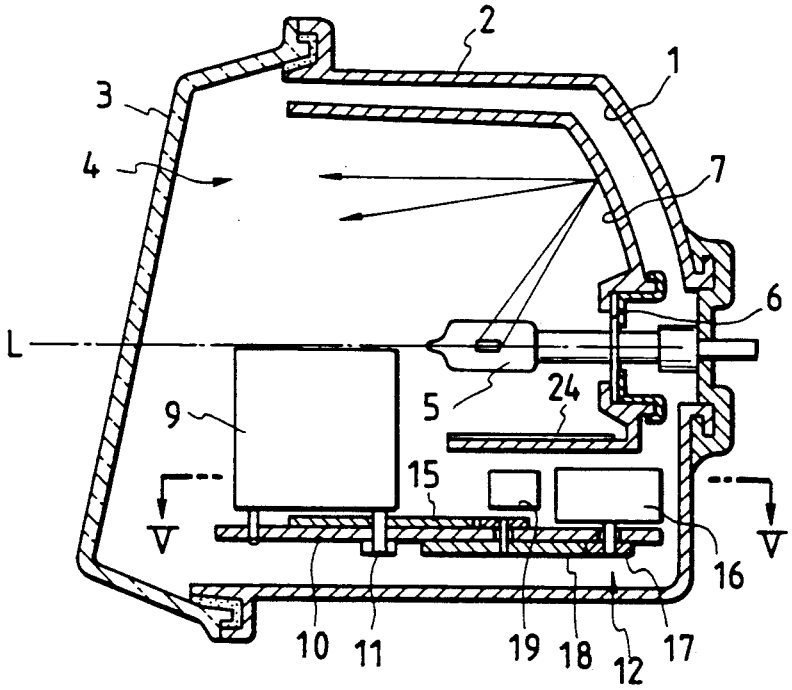
FIG. 1 is a substantially vertical section showing the overall configuration of a first embodiment of a variable distribution type automotive headlamp according to the present o invention.
Figure 2:
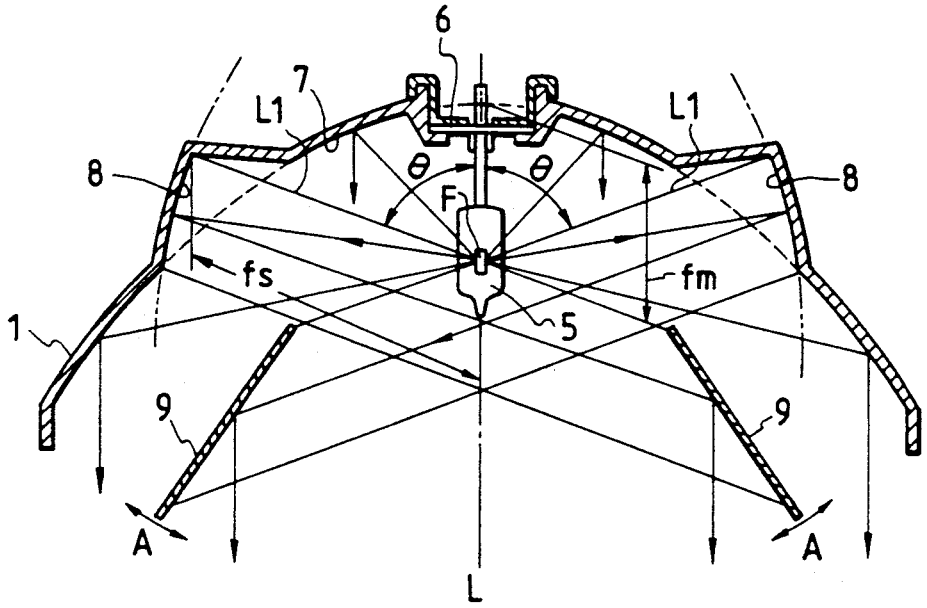
FIG. 2 is a horizontal sectional view showing a main portion of the first embodiment.
Figure 3:
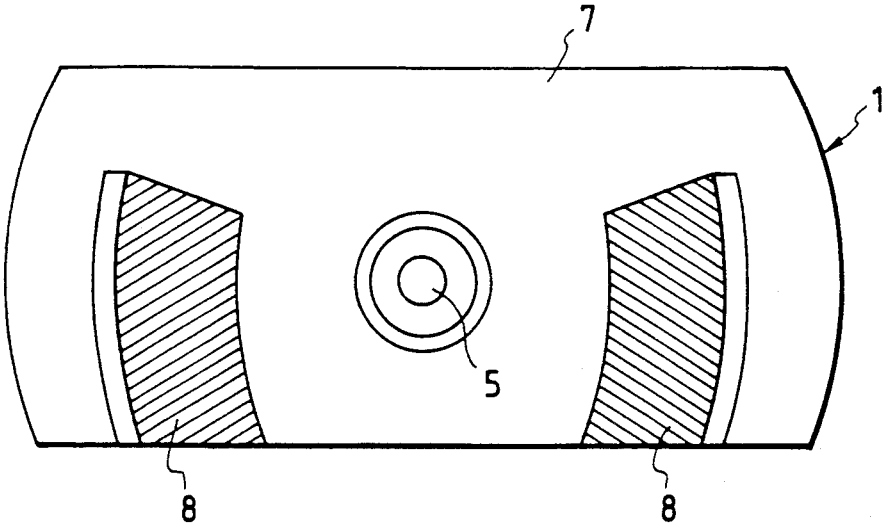
FIG. 3 is a front view of the reflector of the same.
Figure 4:
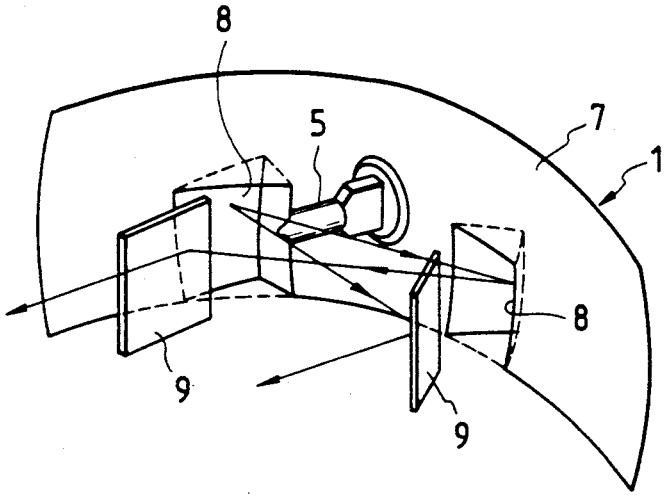
FIG. 4 is a perspective view of a main portion of the reflector.

Referring to the drawings, preferred embodiments of a variable distribution type automotive headlamp constructed according to the present invention will be described.

FIGS. 1 through 7 show a first embodiment of the present invention.

In these drawings, reference numeral 1 designates a reflector formed on the rear end of the inside of a lamp body 2 having an open front surface which is rectangular and horizontally long side to side. A front lens 3 covers the open end of the lamp body 2 to thereby define a lamp chamber 4, and a replaceable single-filament-type bulb 5 is mounted on the optical axis L of the reflector 1 in the lamp chamber 4 through a metal fitting 6.

The reflector 1 has a configuration in which, inside a main reflecting surface 7 composed of a parabolic surface having a focal point F where a filament position of the bulb 5 is located, a pair of subsidiary reflecting surfaces 8 are provided so as to be horizontally symmetrical with each other with respect to the optioal axis L of the main reflecting surface 7. Both subsidiary reflecting surfaces 8 have parabolic reflecting surfaces, and they are disposed so as to be in opposition to each other in such a manner that each optical axis L1 is inclined relative to the optical axis L of the main reflecting surface 7 at an angle $\phi$ in a range of from 45 to 80 degrees in a horizontal plane, and so that the distance fs between the optical axis L and each subsidiary reflecting surface 8 is larger than the distance fm between the focal point F and the center of the main reflecting surface 7 ($fs > fm$).

Further, reference numerals 9 designate movable reflectors provided so as to deflectively reflect the light reflected from the subsidiary reflecting surfaces 8 of the reflector 1 substantially parallel to the optical axis L in the lamp chamber 4. The movable reflectors 9 are fixed to a pair of rotary shafts 11 rotatably provided on a substrate 10, and the movable reflectors 9 are pivotally mounted so as to be controlo lable in rotational displacement in the horizontal directions (arrows A) independently of each other by movable-reflector driving mechanisms 12 (which will be described in more detail below).

Figure 5:
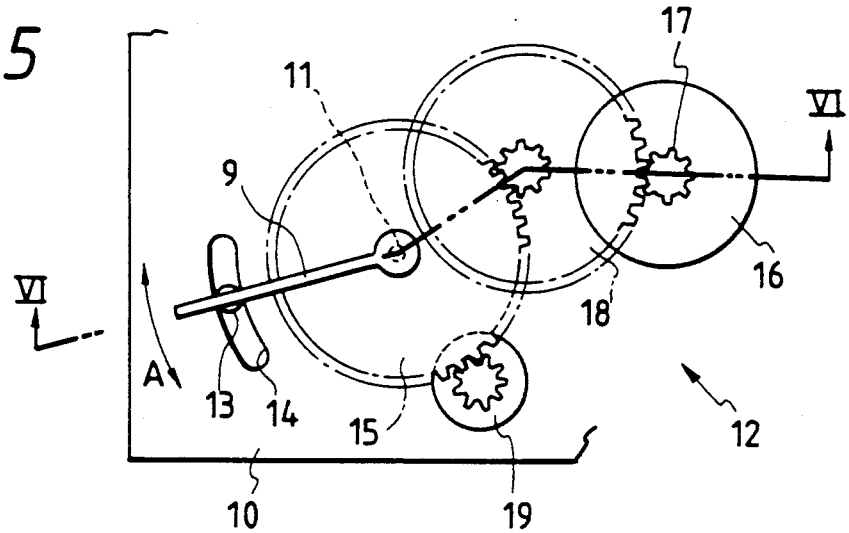
FIG. 5 is an enlarged section taken on a line V—V in FIG. 1.
Figure 6:
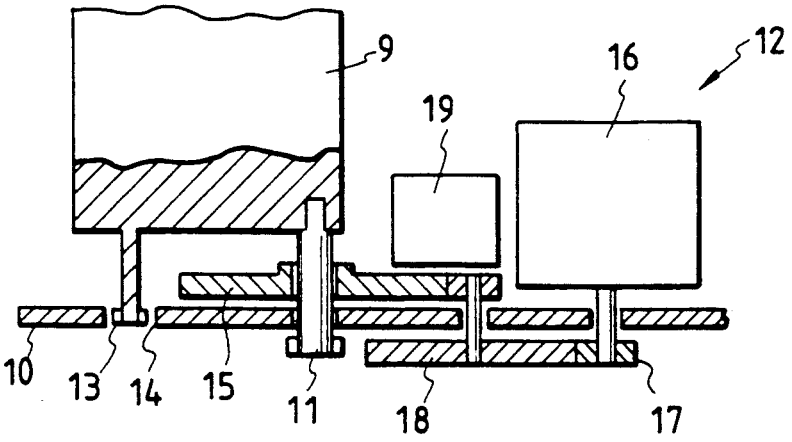
FIG. 6 is a sectional view taken on a line VI—VI in FIG. 5.
Figure 7:
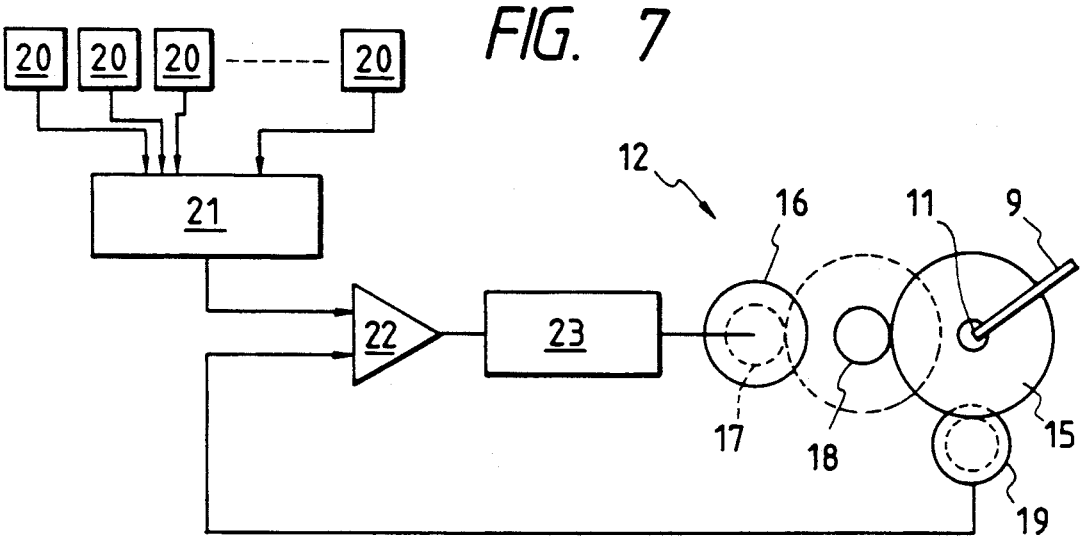
FIG. 7 is a block diagram showing an example of a driving controlling mechanism.

FIGS. 5 through 7 show an embodiment of the movable-reflector driving mechanism 12 in which the movable reflector 9 is fixed at one side thereof to a rotary shaft 11. A guide pin 13 fixed to the reflector 9 slides along a guide groove 14 formed in the substrate 10 so that the reflector 9 is displaceable within the angular range indicated by the arrow A. The rotary shaft 11 is connected to a gear 15, which is connected to a gear 17 mounted on a driving shaft of a DC motor 16 through a speed reduction gear 18. The gear 15 is engaged with the gear of a position detector 19 so as to produce a displacement angle signal indicative of the angle of the movable reflector 9.

As shown in the block diagram of FIG. 7 showing a drive control system in the movable-reflector driving mechanism 12, a signal from a reference voltage generator circuit 21 for selectively producing a predetermined reference voltage on the basis of the signals produced by sensors 20 such as a steering sensor, a vehicle speed sensor, a glaring light sensor, etc., is compared by a comparator 22 with a signal produced by the position detector 19, which is a displacement signal indicative of the angular position of the movable reflector 9. There is thereby produced a comparison output with which the DC motor 16 is forward/reversely driven through a motor driving circuit 23. The DC motor 16 is driven until the detection signal of the position detector 19 fed back to the comparator 20 becomes coincident with the reference value supplied from the reference voltage generator circuit 21 to the comparator 22.

Reference numeral 24 designates a heat shielding plate provided between the reflector 1 and the movable-reflector driving mechanism 12 in the lamp chamber 4.

Figure 8A:
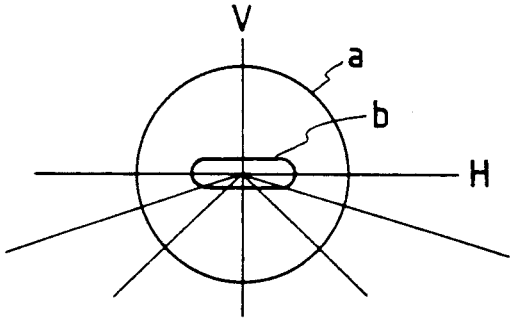
FIGS. 8(*a*) and 8(*b*) are explanatory views showing light-distribution patterns for high -and low beams, respectively.
Figure 8B:
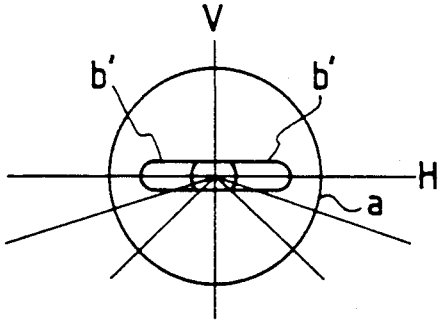
Figure 9:
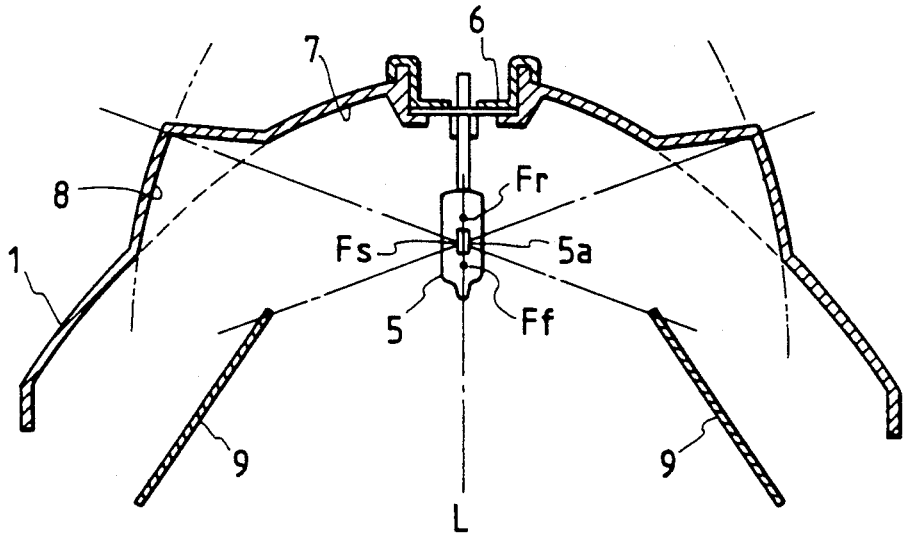
FIG. 9 is a horizontal sectional view showing a second embodiment of the present invention.

The variable distribution type automotive headlamp having a configuration as described above produces a light-distribution pattern on a screen as shown in FIG. 8(*a*). That is, the luminous flux of the main reflecting surface 7 has a substantially circular pattern a, while the luminous flux from the subsidiary reflecting surfaces 8 and the movable reflectors 9 has a rectangular pattern elongated in the horizontal direction H.

Accordingly, when the pair of movable reflectors 9 is controlled so as to be movable in the horizontal direction H, as shown in FIG. 8(*b*), the focusing range can be made narrow, and hence the central luminous intensity can be made high to thereby improve the distant visibility. When the vehicle is running at a low speed, the movable reflectors 9 are rotated to thereby expand the focusing range so as to form a horizontally wide beam b' to improve sideward visibility.

FIGS. 9 through 12 show a second embodiment of the present invention. The structure different from that of the first embodiment will be described hereunder.

Figure 10:
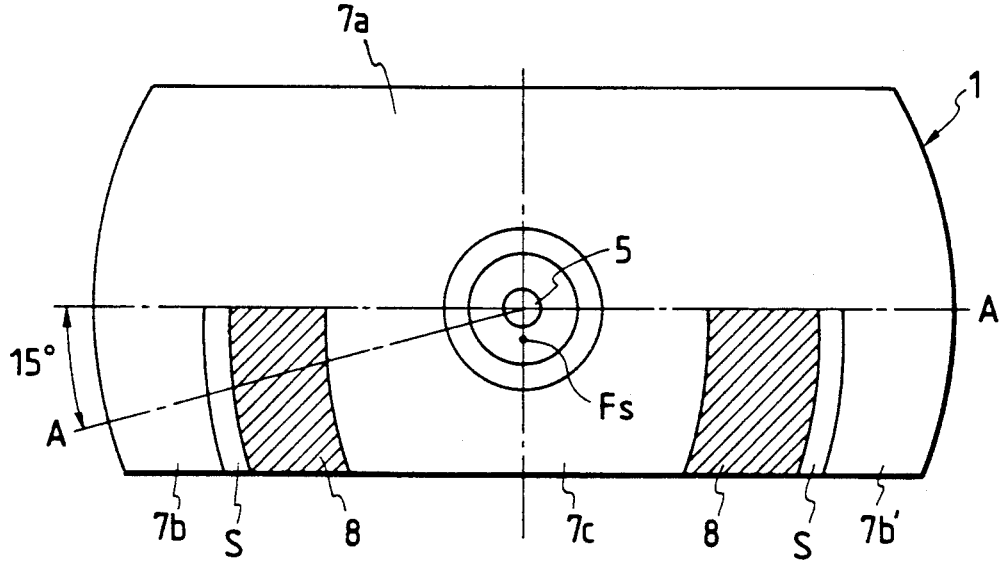
FIG. 10 is a front view of the reflector of the headlamp of FIG. 9.

In the second embodiment, the focal length of a main reflecting surface 7 of a reflector 1 is made different between the upper and lower portions (i.e., the portions above and below a line A—A in FIG. 10). In FIG. 10, a main reflecting portion above the line A—A is indicated by 7*a*, and main reflecting mirror portions under the line A—A are represented by 7*b*, 7*b*, and 7*c*. In order to direct the luminous flux from those portions downward, the focal point Fr of the portion 7*a* is positioned behind the center of a filament 5*a* of a bulb 5, and the focal point Ff of the portions 7*b*, 7*b'* and 7*c* is positioned ahead of the center of the filament 5*a*. Further, in order to direct the luminous flux reflected from the movable reflectors 9 of the subsidiary reflecting surfaces 8 downward, the focal point Fs of a portion s is positioned under the level of the filament 5*a*, or the movable reflectors 9 are pivoted so as to incline downward, and the subsidiary reflecting surfaces 8 are positioned under the level of the optical axis L of the main reflecting surface 7.

Figure 11:
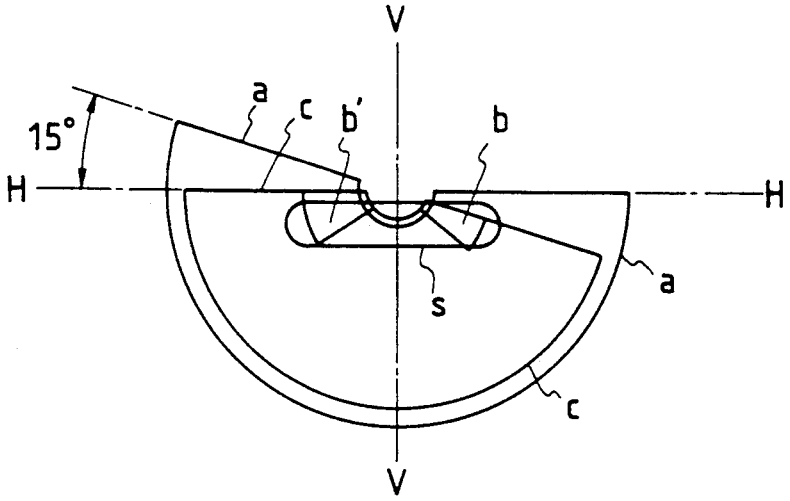
FIG. 11 is an explanatory view showing the light-distribution pattern of the luminous flux produced by the lamp of FIG. 9.
Figure 12A:
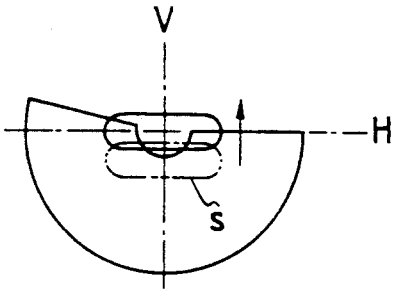
FIGS. 12(*a*) and 12(*b*) are explanatory views showing ligh-tdistribution patterns in the state where the luminous flux is swung upward/downward (FIG. 12(*a*)) and in the state where the illumination of the luminous flux is swung left/right (FIG. 12(*b*))
Figure 12B:
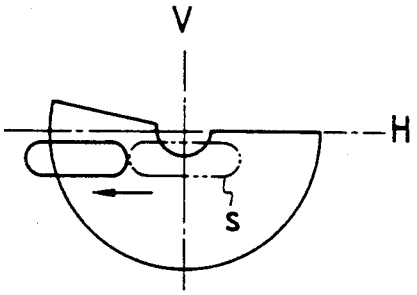

In the variable distribution type automotive headlamp having a configuration as described above, the luminous flux pattern is as shown in FIG. 11. The luminous flux at the portion c of the main reflecting surface 7 is apt to be a cause of glaring light, so that the portion c may be made not reflective. The luminous flux s formed by the subsidiary reflecting surfaces 8 and the movable reflectors 9 is controlled to move upward/-downward or left/right, so that the light distribution pattern as shown in FIGS. 12(*a*) and 12(*b*) can be obtained.

That is, the luminous flux s is moved upward/downward in response to a beam switch, so that the illumination pattern suitable for a high beam or a low beam can be selectively obtained. Further, the luminous flux s is raised to the vicinity of a horizontal line H in response at a certain vehicle speed so that the distance visibility of the low beam can be improved, and further the luminous flux s is moved left/right as determined by the steering angle so that the visibility for cornering can be improved.

Figure 13:
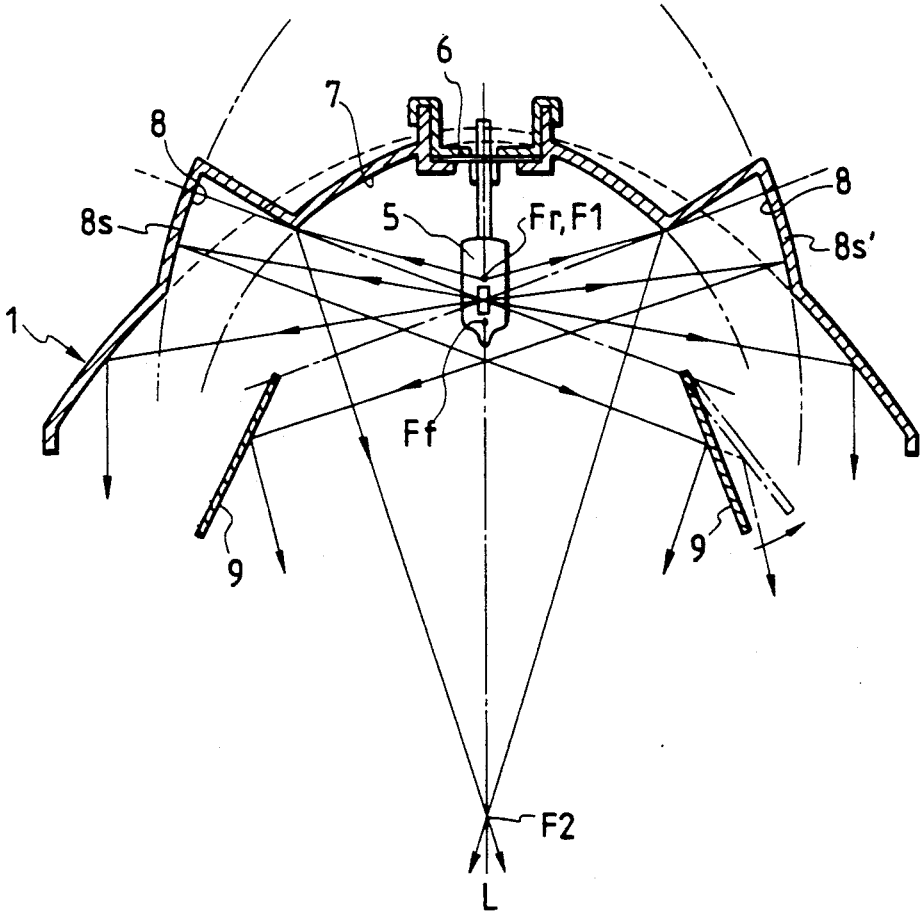
FIG. 13 is a horizontal sectional view showing a main portion of a third embodiment of the present invention.
Figure 14:
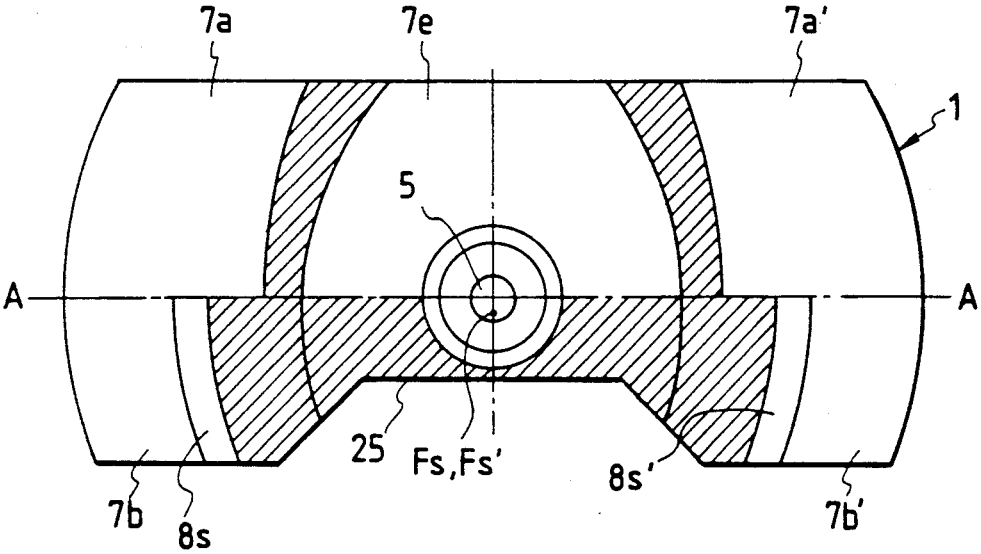
FIG. 14 is a front view of the reflector of the headlamp of FIG. 13.
Figure 15A:
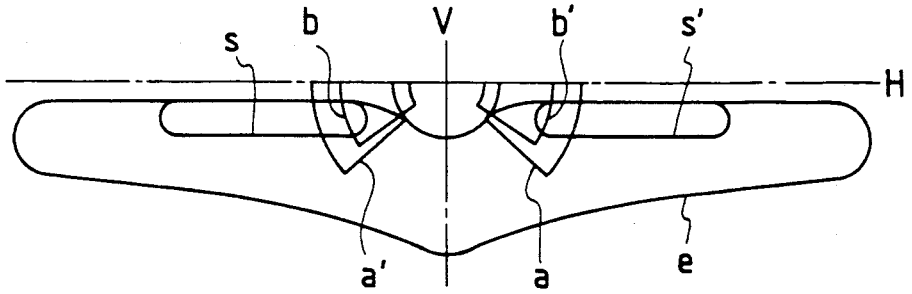
FIGS. 15(*a*) and 15(*b*) are explanatory views showing light-distribution patterns of the beam in the state where the movable reflecting mirrors are in an ordinary state position (FIG. 15(*a*)) and in the state where one of the movable reflecting mirrors is swung (FIG. 15(*b*))
Figure 15B:
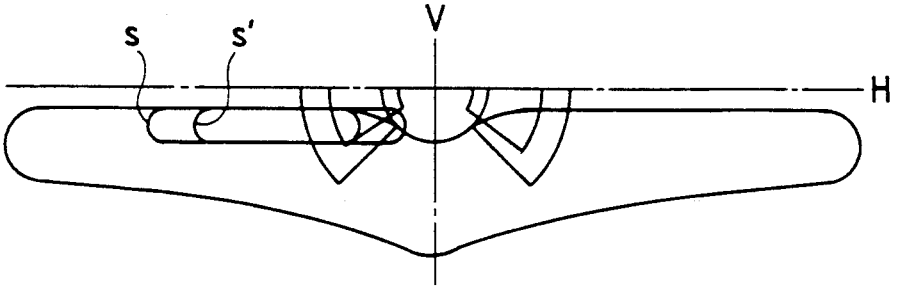
Figure 16:
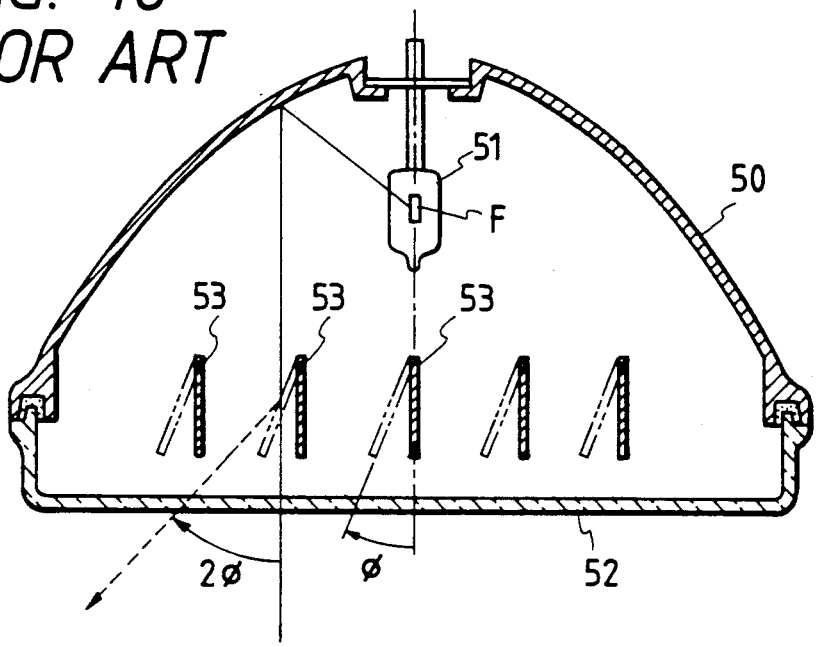
FIG. 16 PRIOR ART
FIG. 16 is a schematic horizontal sectional view showing a conventional variable distribution type automotive headlamp.

FIGS. 13 through 15 show a third embodiment of the present invention.

In this embodiment, a reflector 1 has a structure in which an upper-half central reflector of a main reflector 7 is elliptical in a horizontal section including the optical axis L, and parabolic in vertical section, the parabola having a focal point coincident with a first focal point Fl of the ellipse, and the ellipse having a second focal point F2 on the optical axis forward of the bulb 5. The luminous flux reflected on the central portion of the main reflector 7 is horizontally diffused so as to form a substantially parallel luminous flux in vertical section. Further, portions under a line A—A of the reflector 1, except reflector portions 7*b*, 7*b'*, 8*s* and 8*s'*, are made nonreflective, and a slot 25 for housing a movable-reflector driving mechanism 12 is formed in the reflector 1 at its lower portion.

In the variable distribution type automotive headlamp having such a configuration, when one of the movable reflectors 9 is moved, the light distribution can be deflected as shown in FIG. 15. The luminous flux of the subsidiary reflecting surface s' is changed from the pattern shown in FIG. 15(*a*) to that shown in FIG. 15(*b*).

With this headlamp, when an approaching car is sufficiently distant that the quantity of glaring light received therefrom is small, the luminous flux of the subsidiary reflecting surface portions s and s' is directed toward the main portion of the forward road surface, as shown in FIG. 15(*a*). When the approaching car is sufficiently close that the quantity of light received therefrom exceeds a predetermined level, the luminous flux of the subsidiary reflecting surface portion s' is swung to the side to thereby make the forward visibility high.

Although the movable-reflector driving mechanism 12 is constituted by a DC motor 16 and a position detector 19 in the above embodiments, a similar configuration can be obtained if the DC motor 16 is replaced by a pulse motor. Further, in the case where the movable-reflector driving mechanism 12 is constructed such that each of the movable reflectors 9 is made to move simply between two preset positions so as to be swung in response to the operation of a beam change-over switch, a wiper switch, or the like, a solenoid may be used as a driving source.

Due to the construction of the variable distribution type automotive headlamp according to the present invention as described above, the following advantages are obtained:

(1) The total luminous flux is fixed in magnitude.

(2) Due to the vertically narrow luminous flux, the visibility of the road surface and road sides in the distance can be remarkably improved.

(3) The movable reflectors are deflectively driven in accordance with operating conditions so as to swing the luminous flux, so that nighttime safety is remarkably improved.

What is claimed is:

1. A variable distribution type automotive headlamp, comprising:

a single-filament type bulb;

a reflector, said reflector comprising a main reflecting surface and a pair of subsidiary reflecting surfaces provided within said main reflecting surface and which are left-and-right symmetrical with respect to said optical axis, said bulb being provided on an optical axis of said main reflecting surface, said main reflecting surface having a focal point substantially at the position of said bulb, both said subsidiary reflecting surfaces being arranged opposed to each other so that an optical axis of each of said subsidiary reflecting surfaces is inclined relative to said optical axis of said main reflecting surface within a horizontal plane and within a range of from 45 to 80 degrees, and a distance between said optical axis of said main reflecting surface and each of said subsidiary reflecting surfaces being greater than a distance between a center of said main reflecting surface and a focal point thereof;

at least one movable reflector provided forward of said reflector for reflecting light reflected from said subsidiary reflecting surfaces substantially in parallel to the optical axis; and a movable reflector driving mechanism for pivoting said movable reflector in at least one of a horizontal direction and a vertical direction.

2. The variable distribution type automotive headlamp of claim 1, further comprising a rotary shaft fixed to one end of said movable reflector, a guide pin fixed to said movable reflector and received in a guide groove in a substrate, a first gear fixed to an end of said rotary shaft, a motor, and speed reduction gear means transmitting rotational motion of said motor to said first gear.

3. The variable distribution type automotive headlamp of claim 2, further comprising detecting means rotationally coupled to said first gear for detecting a rotational position of said movable reflector.

4. The variable distribution type automotive headlamp of claim 3, further comprising means for supplying a signal indicative of a desired rotational position of said movable reflector, means for comparing- said signal indicative of a desired rotational position of said movable reflector with an output signal of said detecting means, and means for driving said motor in response to an output of said comparing means.

5. The variable distribution type automotive headlamp of claim 1, wherein said main reflecting surface has different focal lengths for upper and lower portions thereof.

6. The variable distribution type automotive headlamp of claim 5, wherein said upper portion of said main reflecting surface has a focal point behind a center of a filament of said bulb, and said lower portion of said main reflecting surface has a focal point ahead of said center of said filament.

7. The variable distribution type automotive headlamp of claim 6, wherein said lower portion has a part adjacent to and outward of said subsidiary reflecting surfaces having a focal point below a level of said filament.

8. The variable distribution type automotive headlamp of claim 6, wherein said at least one movable reflector is pivoted so as to be inclined downwardly, and said subsidiary reflecting surfaces are positioned below said optical axis of said main reflecting surface.

9. The variable distribution type automotive headlamp of claim 6, wherein a central part of said upper portion of said main reflecting surface is elliptical in horizontal section and parabolic in vertical section.

10. The variable distribution type automotive headlamp of claim 9, wherein a central part of said lower portion is nonreflective.

* * * * *